US005647283A

United States Patent [19]

McKisic

[11] Patent Number: 5,647,283

[45] Date of Patent: Jul. 15, 1997

[54] RAILWAY TRUCK AND STEERING APPARATUS THEREFOR

[75] Inventor: Aubra D. McKisic, Coraopolis, Pa.

[73] Assignee: Hansen Inc., Pittsburgh, Pa.

[21] Appl. No.: 599,376

[22] Filed: Feb. 9, 1996

[51] Int. Cl.[6] ..... B61F 5/00

[52] U.S. Cl. ..... 105/167

[58] Field of Search ..... 105/167, 168, 105/165

[56] References Cited

U.S. PATENT DOCUMENTS

| | | | |
|---|---|---|---|
| 325,532 | 9/1885 | Graff . | |
| 555,857 | 3/1896 | Graham . | |
| 767,863 | 8/1904 | Brown | 105/168 |
| 1,105,291 | 9/1914 | Munn . | |
| 1,493,682 | 5/1924 | Kruger . | |
| 1,744,986 | 1/1930 | Richards | 105/167 |
| 3,789,770 | 2/1974 | List | 105/168 |
| 3,862,606 | 1/1975 | Scales | 105/167 |
| 4,131,069 | 12/1978 | List | 105/168 |
| 4,244,297 | 1/1981 | Monselle | 105/168 |
| 4,258,629 | 3/1981 | Jackson et al. | 105/167 |
| 4,300,454 | 11/1981 | Scheffel | 105/168 |
| 4,480,553 | 11/1984 | Scheffel | 105/167 |
| 4,628,824 | 12/1986 | Goding et al. | 105/168 |
| 4,660,476 | 4/1987 | Franz | 105/168 |
| 4,676,172 | 6/1987 | Bullock | 105/168 |
| 4,679,507 | 7/1987 | Rassaian | 105/168 |
| 4,729,324 | 3/1988 | List | 105/168 |
| 4,781,124 | 11/1988 | List | 105/168 |
| 4,841,873 | 6/1989 | Goding et al. | 105/168 |
| 4,889,024 | 12/1989 | List | 105/167 |
| 4,903,613 | 2/1990 | Lang et al. | 105/167 |
| 4,938,152 | 7/1990 | List | 105/208 |
| 5,000,097 | 3/1991 | List | 105/167 |

OTHER PUBLICATIONS

"Supplier, Inventor Market Steering Car Truck" Modern Railroads, Technology News, Mar. 1990, pp. 62–63.

*Primary Examiner*—Mark T. Le
*Attorney, Agent, or Firm*—J. Stewart Brams

[57] ABSTRACT

A railway truck and steering apparatus therefor having rigid steering arms which are fixed with respect to a pair or longitudinally spaced railway truck wheelsets, and preferably the axial ends thereof, in a manner to have an essentially fixed angular relationship in the horizontal plane with respect to the respective truck wheelsets, the steering arms extending from the respective truck wheelsets with pairs of steering arms being connected together in a manner to constrain the truck wheelsets to yaw in a mutually opposed sense and remain substantially fixed in axial shear relative to each other while being free to move longitudinally with respect to each other.

21 Claims, 4 Drawing Sheets

RAILWAY TRUCK AND STEERING APPARATUS THEREFOR

BACKGROUND OF THE INVENTION

In the railway rolling stock arts it is well known to provide a railway truck to support a car body with respect to the track by means of a plurality of wheelsets which are disposed in rolling engagement on the railway track. For example, the well known three piece truck commonly employed in freight haulage service includes a pair of laterally spaced, elongated side frames which are supported adjacent their longitudinal ends by a pair of bearing adapters supported on roller bearing assemblies carried by respective wheelset axle ends. A bolster extends transversely between the side frames and its ends are supported in the side frame transom windows by load spring groups to thereby provide sprung support for the bolster and the car body, which is supported on a center plate bearing portion of the bolster.

In a conventional three piece freight car truck, the two longitudinally spaced wheelsets are kinematically constrained by their connecting side frames to run in an approximately parallel fashion, although sustained lateral wheelset oscillations can occur. This well-known phenomenon, often referred to as hunting, is characterized by relative lateral shear and in-phase yaw between the wheelset axles. To prevent hunting, low operating speed limits often must be observed.

Constraint of the wheelset axles by the side frames in a substantially parallel relation also inhibits the movement of the wheelsets to a radial position while negotiating track curves. This results in a non-zero angle of attack for the axle. The wheelset is therefore guided through the track curve by flange-to-rail contact, thereby increasing both rolling resistance and wear.

Practitioners in the art have continually sought improved structures for enhanced inter-axle constraint of railway truck wheelsets to limit inter-axle shear and to implement truck steering through coordinated, mutually opposed wheelset yaw movements.

The prior art includes numerous examples of railway truck wheelset inter-engagement schemes. The following issued patents are representative: U.S. Pat. Nos. 4,131,069, 4,729,324, 4,781,124, 4,889,054, 4,628,824, 4,244,297, 4,841,873, 325,532, 555,857, 1,105,291, 4,676,172, 1,493,682, 4,300,454, 4,480,533 and 4,258,629.

BRIEF SUMMARY OF THE INVENTION

The present invention contemplates a novel and improved railway truck and steering apparatus therefor which improves both the radial curving performance and lateral stability of a railway truck having at least a pair of longitudinally spaced wheelsets, for example a standard three piece truck. The novel steering apparatus limits and controls the lateral shearing movement of a pair of truck wheelsets thus inhibiting truck parallelograming. The steering apparatus also constrains the truck wheelsets to yaw in a mutually opposed sense thus encouraging them to assume a true radial orientation on curved track. The steering apparatus also accommodates longitudinal inter-wheelset freedom. Accordingly, all reaction forces of braking can be borne by the truck side frames, and variations in pedestal length are readily accommodated.

More specifically, one presently preferred embodiment of the invention contemplates a pair of elongated, interconnected, rigid steering arms, each secured at a substantially fixed angularity with respect to the respective wheelset axle ends at one lateral side of the railway truck. A second entirely similar pair of interconnected steering arms is similarly secured with respect to the wheelset axle ends at the opposed lateral side of the truck. The two steering arms of each pair project longitudinally from the respective wheelset axle ends toward one another and are pivotally engaged with one another intermediate the spaced wheelsets in a manner that they independently allow the wheelset axles to develop an inter-axle yaw angle while inhibiting inter-axle shearing movements, i.e. relative movement of the axles with respect to each other generally in the direction of the wheelset rolling axis. The wheelsets also remain free to translate longitudinally with respect to each other and with respect to the truck side frames.

The steering arm interconnection which provides these modes of inter-axle constraint and freedom may preferably be a pivot connection which is free to translate, within limits, with respect to the steering arms in a direction generally transverse to the corresponding wheelset rolling axis.

The invention contemplates various steering structures affixed with respect to railway truck wheelsets, including some with mutual interconnection of the steering structures attached to the respective wheelsets by laterally opposed connections located adjacent the opposed lateral sides of the truck. The laterally opposed connections are operable independently to permit the wheelsets freedom of relative longitudinal translation and yaw movement while constraining them to yaw only in mutually opposed senses, and further constraining the wheelsets against relative lateral shearing movement such as occurs in truck hunting.

The invention also contemplates structures to accommodate controlled wheelset yaw freedom with respect to the side frames of the truck. Such structures may include an elastomeric shear pad or a pivot bearing interposed between the wheelset bearing adapters and respective contact surfaces of the side frame pedestal openings. As the wheelset bearing adapters bear a fixed angular relationship to the wheelset axles and a variable angular relationship to the side frames, one approach contemplated for mounting the steering arms according to this invention is to secure them in a fixed angular relationship to the respective wheelset bearing adapters.

The invention as characterized above allows at least three degrees of freedom between a pair of railway truck wheelsets. First, the wheelsets are free to yaw in the horizontal plane with respect to each other. Second, the wheelsets are free to translate longitudinally with respect to each other. Third, under certain conditions the wheelsets can exhibit very limited relative axial shear freedom with respect to each other, although in fact other elements of the system will tend to restrain such wheelset lateral shear as explained below. By its accommodation of wheelset freedom as described, the invention also relieves the interconnected steering arms of braking loads and accommodates variations in wheelbase length due to side frame casting tolerance variation.

Concerning the relative wheelset shear freedom, when the wheelset axles are disposed at a non-zero inter-axle yaw angle it is kinematically possible for one wheelset to migrate longitudinally toward or away from the rolling axis of the other wheelset, thereby producing a lateral shear displacement between the two wheelsets. However, since the maximum attainable inter-axle wheelset yaw angle is very small, the maximum angle between either pair of interconnected steering arms will also be very small. Accordingly, any lateral shear displacement between the wheelsets resulting from longitudinal migration of one wheelset toward or away from the rolling axis of the other wheelset will be extremely limited because the lateral component of such migration is only a very small proportionate part of the longitudinal component, the proportionality factor being the sine of the inter-axle yaw angle.

Even with a very small non-zero angle between the interconnected steering arms, and a correspondingly very small lateral shear component, the pivot pin which connects the steering arms must migrate through at least a small longitudinal distance with respect to one or both of the connected steering arms in order to accommodate any lateral shear displacement at all between the wheelsets. Thus, any axial force on one of the wheelsets that tends to promote lateral shear displacement will be transferred through the respective steering arms to the pivot pin connection therebetween. Again, due to the extremely small maximum inter-axle yaw angle, any such axial wheelset force transferred to the steering arm pivot connection will be directed essentially perpendicular to the path along which the pivot connection can migrate. Accordingly, the longitudinal force component acting on the pivot connection, that is, the force component acting in the direction of the pivot pin migration required to accommodate relative wheelset shear displacement, will be correspondingly small. It is unlikely this force component would be great enough to overcome the opposed restraining forces, such as friction between the pivot pin and the connected arms, or an elastomeric centering force, which resists the pivot pin migration. In any event, as noted pin migration that could occur would accommodate only a negligible lateral shear displacement between the wheelsets due to the very small maximum angle between the connected steering arms.

The invention also contemplates the application of viscous and/or frictional damping, for example at laterally opposed sides of the truck, to resist inter-axle yaw and thereby improve wheelset yaw stiffness. Yaw restraint thus is not limited to that available in the interface between the bearing adapters and the respective pedestal jaws.

The invention as characterized affords improved inter-axle freedom and restraint for a railway truck, especially a conventional three piece truck. The resulting effective control of inter-axle movement, including damping, can significantly improve control of truck hunting responses and truck steering and curving performance.

It is therefore one object of the invention to provide a novel railway truck.

Another object of the invention is to provide a novel and improved railway truck and an axle interconnecting apparatus therefor.

Another object of the invention is to provide a novel and improved steering apparatus for longitudinally spaced wheelsets of a railway truck.

Still another object of the invention is to provide a novel and improved railway truck and steering apparatus therefor with wheelsets which are spaced longitudinally apart and are constrained to yaw with respect to each other in a mutually opposed sense while remaining free to move longitudinally with respect to each other and with respect to the truck side frames.

These and other objects and further advantages of the invention will be more fully appreciated upon consideration of the following detailed description and the accompanying drawings, in which.

Figure 1:
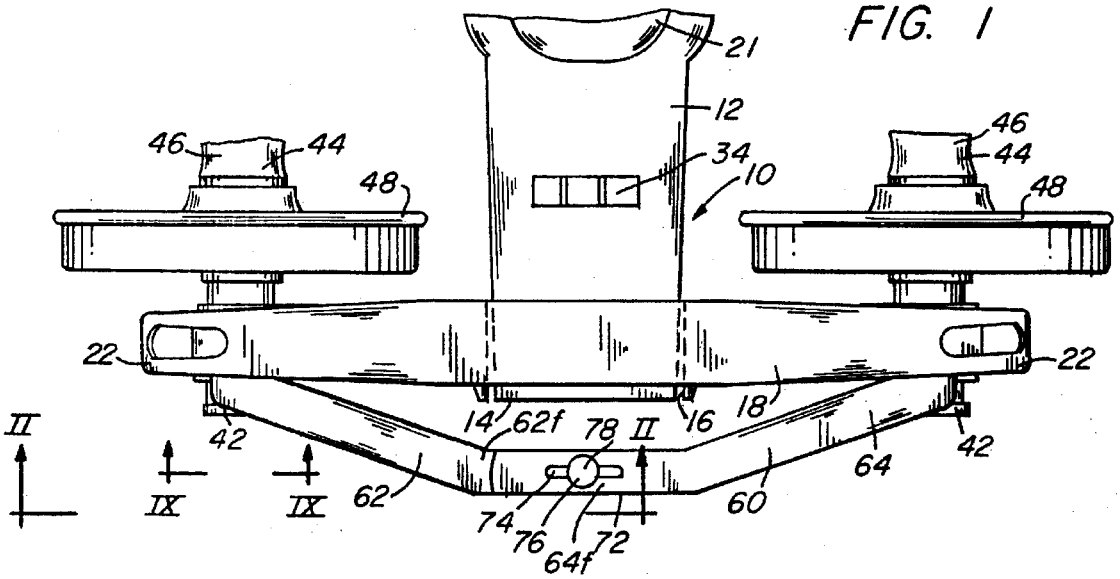
FIG. 1 is a top plan view of a fragmentary portion of a railway truck and steering apparatus of the instant invention.
Figure 2:
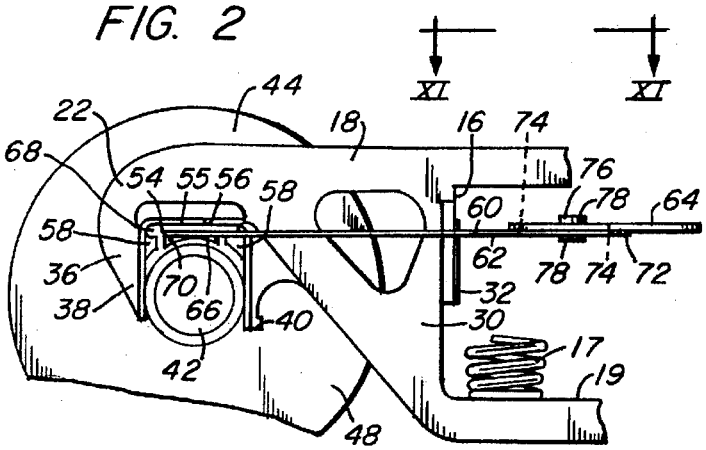
FIG. 2 is a fragmentary side elevation taken on line II—II of FIG. 1.

There is generally indicated at 10 in FIGS. 1 and 2 a railway truck shown for purposes of description as a three piece truck although it will be understood that the invention is not limited to three piece trucks. The truck 10 typically supports one end of a car body for travel along conventional railway track. Truck 10 comprises an elongated rigid bolster 12, shown in fragmentary part and having a pair of longitudinally opposed end portions 14 which are received within respective transom openings 16 of a pair of laterally spaced side frames 18, only one of which is shown in FIG. 1.

Load springs 17 carried upon a floor or base portion 19 of transom opening 16 engage an under surface of the adjacent bolster end portion 14 for sprung support of the bolster 12 with respect to the side frame 18. Bolster 12 includes an upwardly facing center plate bearing portion 21 intermediate its longitudinal ends, and side bearings 34 spaced laterally from centerplate bearing 21 for support of a railway car body (not shown).

Each side frame 18 comprises an elongated, rigid unitary body having a pair of opposed; integrally formed pedestal end portions 22. Each side frame transom opening 16 includes longitudinally opposed column portions 30 with respective opposed column surfaces 32 which are engaged by respective friction shoes or shoe assemblies (not shown) received in respective bolster pockets (not shown), as is well known.

Each side frame pedestal end 22 includes a pedestal portion 36 having respective longitudinally spaced pedestal jaw portions 38 and 40 between which is received a roller bearing assembly 42 of a conventional railway truck wheelset 44. Each wheelset 44 comprises an axle 46 having a pair of conventional, flanged, conical railway truck wheels 48 affixed thereon adjacent the respective roller bearing assemblies 42.

Opposed thrust lugs 58 are sometimes formed on the pedestal jaw portions 38 and 40 as shown, and a bearing adapter assembly 54 is received longitudinally intermediate the opposed thrust lugs 58 and in partially surrounding or encompassing relation with the respective wheelset roller bearing assembly 42. An upper surface 55 of each bearing adapter assembly 54 is maintained in load bearing engagement with a downwardly facing pedestal roof surface portion 56.

Each bearing adapter assembly 54 may include an elastomeric element disposed atop a rigid bearing adapter to provide an elastically compliant interface between the rigid adapter and the pedestal surface 56 for purposes of wear reduction, accommodation of relative movements between the wheelsets and the side frames, and for damping of such relative movement. In particular, such an elastomeric element may be deformable in both shear and compression in various planes to accommodate relative movements occurring between the wheelsets and the side frames of the truck as the wheelsets yaw horizontally with respect to the side frames. In addition, the relative yawing movement of the wheelsets is partially restrained by the damping effect of elastic deformation of the elastomeric element, including compression and shear deformations, and frictional sliding engagement of the elastomeric elements upon surface 56 and/or upon a corresponding engagement surface with the rigid bearing adapter element. One suitable bearing adapter comprised of rigid and elastomeric elements as above described is manufactured by the Lord Corporation of Erie, Pa.

All of the above railway truck components are known in the art and form no part of the instant invention except in combination with hitherto unknown railway truck structures as described hereinbelow. Further description of such known truck components is unnecessary for a full understanding of the present invention.

It is known in the art that a railway truck must of necessity exhibit various modes of flexibility among the truck components in order to negotiate curved track and to permit the wheel conics, in cooperation with the cylindrical rail heads, to be effective for truck steering. One required mode of flexibility is horizontal yaw of the wheelsets with respect to the side frames. The wheelsets are able to yaw in the horizontal plane with respect to each other and with respect to the truck side frames by virtue of clearance between the wheelset bearing adapter assemblies and respective fore and aft confronting surfaces of the side frame pedestal openings. These clearances must also accommodate limited relative lateral movement and rotary movement of the bearing adapters with respect to the pedestal openings. The resulting wheelset yaw freedom permits the wheel conics to operate with best effect for truck steering; however, uncontrolled or unrestrained wheelset yaw can also result in undesirable truck parallelograming which is characterized by the wheelsets yawing in phase with each other.

In order to control wheelset yaw and generally to constrain the wheelsets of a truck to yaw only in opposed senses the invention contemplates a steering assembly 60 including a pair of elongated steering arms 62 and 64. One end of each steering arm is rigidly affixed to a respective one of two bearing adapters 54 associated with a given truck side frame 18. For example, each steering arm 62, 64 may be formed as a plate member, as shown, having a downturned, laterally inwardly facing end portion 66 which is located adjacent an outer side surface 68 of the respective bearing adapter 54 and is secured thereto by such suitable fasteners as threaded bolts 70.

The steering arms 62 and 64 thus extend longitudinally from the respective bearing adapters 54 associated with each side frame 18 and the free ends of the steering arms 62, 64 overlap as shown at 72 laterally outwardly adjacent the side frame 18.

The overlapping steering arm end portions, designated as **62*f* and 64*f* in FIG. 1, include elongated apertures 74 which are disposed in mutual registry to receive a fastener such as a pin 76. Pin 76 includes opposed head portions 78, for example cylindrical head portions, which are of a larger diameter than the maximum lateral width of the apertures 74 so that the overlapping steering arm end portions 62*f*, 64*f* are secured adjacent one another in the mutually overlapping relation. Pin 76 does not, however, bind or clamp the overlapping steering arm end portions together and they thus remain free to slide longitudinally and rotate about pin 76 with respect to each other to any relative position which can be accommodated by the extent of apertures 74, and by the limits of longitudinal and yaw freedom of the wheelsets 44 with respect to side frames 18**.

Just as only one side frame of a truck is shown in FIGS. 1 and 2 together with the associated fragmentary portions of the truck bolster and wheelsets, only a single steering assembly 60 is shown in FIGS. 1 and 2. It will be understood that an identical steering assembly 60 is associated with the bearing adapters which support the opposed side frame 18 with respect to wheelsets 44. The above described wheelset movements, including relative yaw movements and longitudinal translation with respect to the side frames, are accommodated by both of the steering assemblies 60.

Figure 3:
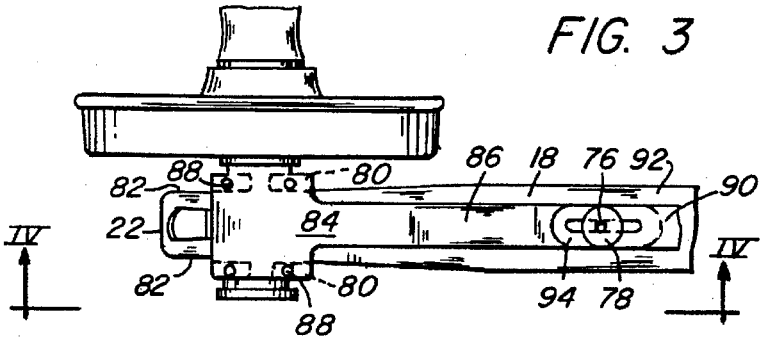
FIG. 3 is a top plan view of a railway truck in fragmentary part showing an alternative embodiment of the instant invention.
Figure 4:
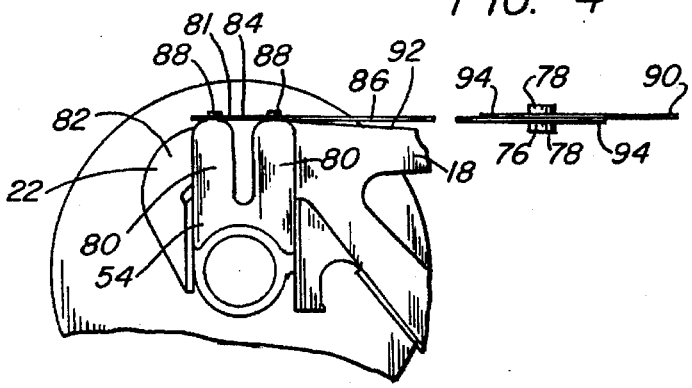
FIG. 4 is a fragmentary side elevation taken on line IV—IV of FIG. 3.

An alternative embodiment of the invention as shown in FIGS. 3 and 4 comprises structural elements entirely similar to those described hereinabove with reference to FIGS. 1 and 2, except that bearing adapters 54' include one or more upstanding lugs 80 which are formed integrally with each of the laterally opposed sides of the bearing adapter 54' and extend upwardly therefrom adjacent the laterally opposed side surfaces 82 of side frame pedestal or end portion 22. Each lug 80 projects at least up to, and preferably slightly above the uppermost surface 81 of the respective side frame pedestal portion 22 to receive thereon one end 84 of a steering arm 86 which is secured atop the respective lugs 80 as by threaded fasteners such as bolts 88.

The steering arm 86 extends longitudinally of the respective side frame 18 generally above an upper surface 92 thereof, rather than laterally outward of the side frame 18 as in the first-described embodiment. An end portion 94 overlaps a corresponding end portion 94 of an entirely similar steering arm 90 which is affixed in similar fashion to a bearing adapter (not shown) engaged in the longitudinally opposed pedestal opening of the side frame 18. The configuration and mutual engagement of steering arm end portions 94 may be identical to that described hereinabove with reference to FIGS. 1 and 2.

Figure 5:
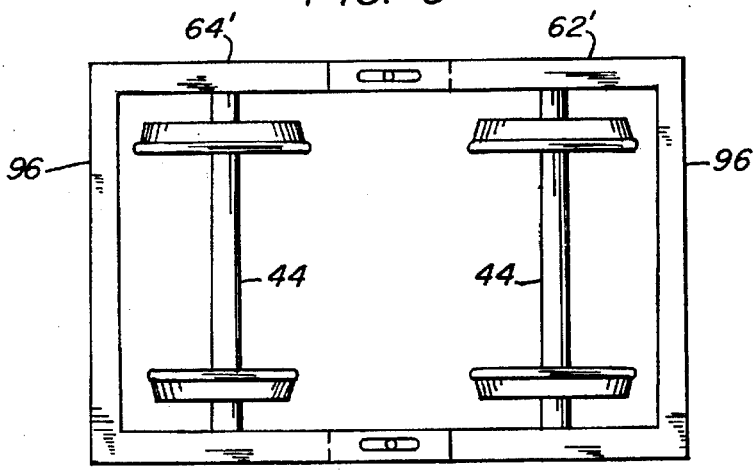
FIG. 5 is a generally schematic top plan view of a modified embodiment of the invention.

In a modified embodiment of the invention as shown schematically in FIG. 5, steering arms 62', 64' are connected to wheel and axle sets 44 and include overlapping steering arm end portions with mutually registering elongated apertures through which a pivot pin or similar fastener extends, just as in the above-described embodiments. The overlapping end portions thus are maintained in mutually slidable and rotatable engagement.

The embodiment of FIG. 5 further contemplates additional steering arm structure comprised of a steering frame 96 which is preferably integral with, or at least rigidly interconnected to the respective opposed steering arms 62', 64' at each axial end of a wheelset 44. Frame 96 is a rigid structure which carries steering moments that would otherwise be transferred from one steering arm 98 to its counterpart at the opposite end of the same wheelset axle by the wheelset axle itself, such as occurs in the FIGS. 1–4 embodiments. In the FIG. 5 embodiment, frame elements 96 largely internalize such moments thereby relieving the wheelset axles and roller bearings of a major part of the corresponding loads. In a modification of the FIG. 5 embodiment, the frame elements 96 may extend between steering arms 62', 64' and be fixed rigidly with respect thereto at a location longitudinally intermediate the wheelsets 44 rather than longitudinally outward of the wheelsets 44.

Figure 6:
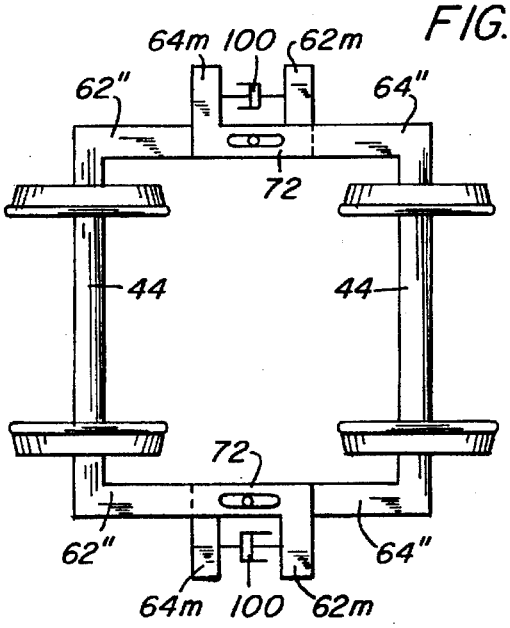
FIG. 6 is a generally schematic top plan view of another modified embodiment of the invention.

In a further embodiment of the invention as shown in FIG. 6, a pair of truck wheelsets 44 have steering arms 62" and 64" affixed with respect thereto, and the overlapping steering arm ends are mutually engaged as at 72 in the identical manner as described hereinabove with reference to FIGS. 1–4. In addition, however, to control and damp the relative movements occurring between the overlapping steering arm end portions, a suitable viscous damper such as a dash pot 100 is provided in inter-engaging relation between respective mounting portions *62m*, *64m*, of each pair of connected steering arms to thereby provide a velocity dependent resistance to constrain relative longitudinal and yaw movements between the wheelsets 44. Other modes of restraint for inter-axle yaw and longitudinal translation are contemplated, including dry friction and elastomeric material compressive and/or shear deformation. Combinations of these also may be employed as still other alternatives.

Figure 7:
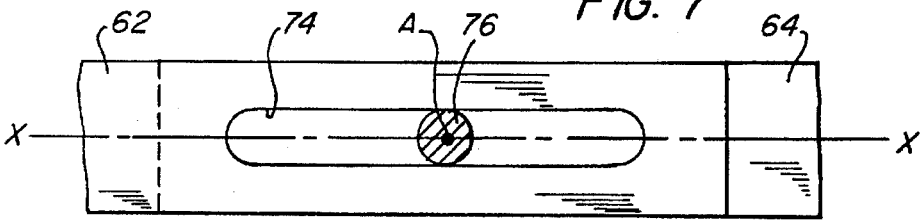
FIG. 7 is an enlarged, fragmentary portion of FIG. 5 showing the relative positions of a pair of interconnected steering arms according to the invention when the truck wheelset inter-axle yaw angle is 0 degrees.
Figure 8:
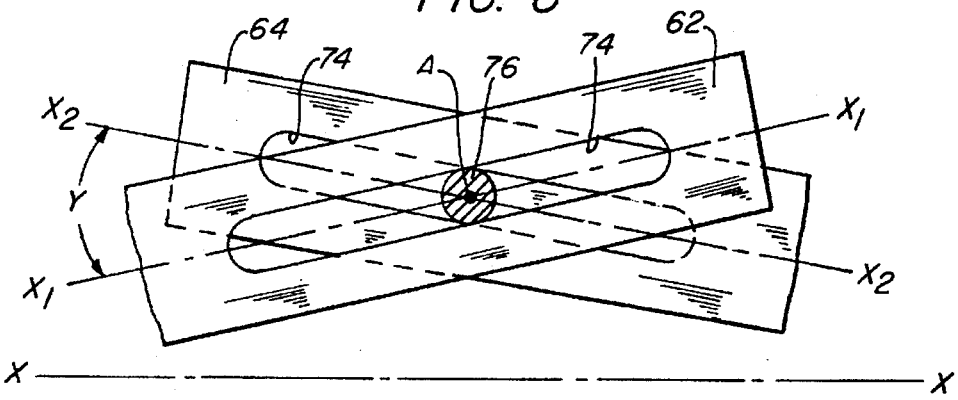
FIG. 8 is a view similar to FIG. 7 showing the relative positions of the interconnected steering arms when the inter-axle yaw angle is a non-zero value.

From the above description, the operation of the described steering apparatus may be appreciated. Referring specifically to FIGS. 7 and 8, one pair of the overlapping, pivotally connected steering arms 62, 64 is shown in FIG. 7 with a pin 76 extending through mutually registered elongated slots 74 to pivotally connect the overlapping ends of steering arms 62 and 64. When the wheelsets of the truck are aligned in parallel orientation (i.e. exhibiting and inter-axle yaw angle of 0 degrees) the connected end portions of steering arms 62 and 64 as well as slots 74 in the overlapping ends are mutually disposed on a longitudinal axis X—X, and the central axis A of pin 76 intersects axis X—X.

As may be seen from FIG. 7, pin 76 is of a diameter that it is free to slide longitudinally, although preferably with minimal lateral free play, within the mutually registered slots 74. Accordingly, steering arms 62 and 64, when aligned as in FIG. 7, are free to move longitudinally with respect to each other whereby the wheelsets are also free to translate longitudinally within the limits of their longitudinal freedom with respect to the side frame pedestal openings.

When one wheelset begins to yaw horizontally with respect to the other the outermost end of one steering arm will both translate laterally and rotate with respect to axis X—X, for example moving to a position upon a displaced axis $X_1$—$X_1$ as shown for steering arm 62 in FIG. 8. The elongated slot 74 of that steering arm also extends on axis $X_1$—$X_1$. The lateral movement of steering arm 62 to axis $X_1$—$X_1$ also moves pin 76 laterally. By its engagement within slot 74 of the other steering arm 64, the pin 76 urges the other steering arm 64 to a position spaced laterally and rotated with respect to from axis X—X in the same direction as the displacement of axis $X_1$—$X_1$ therefrom, for example to a corresponding axis $X_2$—$X_2$. Accordingly, any impetus tending to yaw a wheelset horizontally in one direction acts through the pivot connection at pin 76 to rotate or yaw the other wheelset in the opposed direction of yaw, thus inevitably resulting in a configuration such as shown in FIG. 8 wherein the overlapping steering arm ends continue to overlap but at an angle Y between the axes $X_1$—$X_1$ and $X_2$—$X_2$. Angle Y is equal to the inter-axle yaw angle between the respective wheelsets, and in FIG. 8 its magnitude has been greatly exaggerated for purposes of clarity.

It will thus be appreciated that for any available angle of yaw Y between a pair of overlapping steering arms 62, 64, the respective slots 74 continue to at least partially overlap, whereby pin 76 is always accommodated within an intersecting region of slots 74 with the axis A thereof disposed on the intersection of axes $X_1$—$X_1$ and $X_2$—$X_2$. Still further, in a generalized yaw condition at an inter-axle yaw angle Y such as shown in FIG. 8 the steering arms remain free to move longitudinally with respect to each other without any resulting impetus toward increased or decreased inter-axle yaw. Accordingly, for any yaw condition between the respective wheelsets of a truck, including the full range of inter-axle yaw movement from a maximum inter-axle yaw angle in one direction to a maximum inter-axle yaw angle in the opposed direction, the steering arm interconnection leaves the respective wheelsets continuously free to traverse longitudinally with respect to each other.

Of course it will be understood that the steering arm representations in FIGS. 7 and 8 may be the steering arms on either lateral side of a truck, and that the movement of a pair of overlapping steering arm ends under conditions of inter-axle yaw as described hereinabove will be identical for either of the opposed pairs of pivotally connected steering arms on a given truck. The steering arms of a yawing wheelset thus serve to simultaneously transmit, through the pivot pin connections 76, a corresponding opposed yaw impetus to the other wheelset.

The longitudinal freedom of pins 76 within mutually registered slots 74 permits a range of longitudinal freedom between each pair of overlapping steering arms sufficient that variations in inter-pedestal spacing between any given pair of side frames will not create steering apparatus assembly difficulties nor require fine adjustment of the steering components upon assembly. Additionally, the described longitudinal wheelset freedom relieves the steering assembly entirely of all truck braking loads whereby the design parameters for the steering arm need accommodate only the laterally directed yaw loads that the mutually engaged pairs of steering arms must transmit between the wheelsets. The steering arms designed according to such minimal design criteria can be far lighter in weight and of smaller section than prior truck steering apparatus. The attendant benefits of reduced dead weight, reduced manufacturing cost, increased ease of truck assembly, and reduced space requirements for the steering apparatus are also realized.

Figure 9:
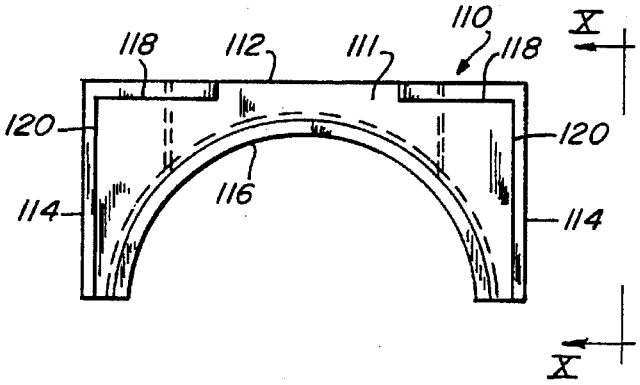
FIG. 9 is a side elevation taken from the location of line IX—IX in FIG. 1 showing a wheelset bearing adapter.

FIGS. 9 to 13 illustrate structural details of a preferred embodiment of the invention as above disclosed. Specifically, a bearing adapter 110 is shown in FIG. 9. Bearing adapter 110 includes a rigid body 111, a steel casting for example, having an upper surface portion 112, a pair of longitudinally opposed, generally vertically extending end surface portions 114, and a lower, generally concave surface portion 116. As is well known, these surfaces of bearing adapter 110 fit up with a side frame pedestal portion and a wheelset bearing to confine and support the side frame with respect to the wheelset bearing.

Specifically, the downwardly facing roof surface of a conventional side frame pedestal opening is supported by engagement upon surface 112 and longitudinal end surfaces of the pedestal opening, commonly including thrust lugs 58 as shown in FIG. 2, confront the respective surfaces 114 of the bearing adapter 110 to partially confine the pedestal portion with respect to bearing adapter 110 and to limit the range of relative movement therebetween. Additional structural elements such as gibs or other solid stops may be utilized to confine and limit relative movement of the side frame pedestal with respect to bearing adapter 110. In turn, surface 116 is engagable with the outer housing of a wheelset roller bearing assembly whereby the side frame is supported with respect to a wheelset as above described.

Figure 10:
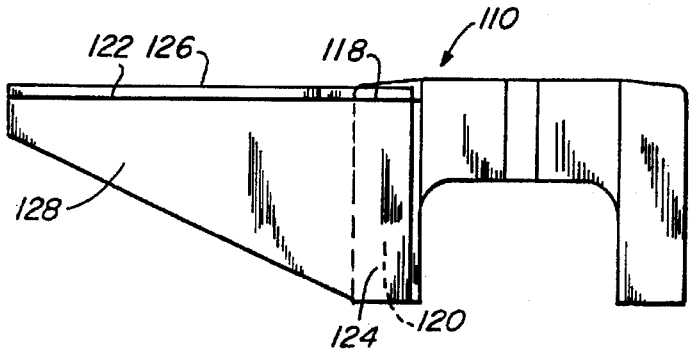
FIG. 10 is an end elevation taken on line X—X of FIG. 9 and showing the bearing adapter of FIG. 9 with a steering arm bracket attached thereto.

A laterally outer side of bearing adapter body 111 includes surface means such as recessed surfaces 118 and 120 to receive a steering arm support bracket 122 (FIG. 10). Specifically, surfaces 118 are upwardly facing surfaces which extend longitudinally from opposed ends of bearing adapter body 111 whereas surfaces 120 extend generally vertically on the opposed longitudinal ends of body 111. The surfaces 118 and 120 are suitably formed to receive in cooperable engagement the steering arm support bracket 122, and specifically a mounting portion 124 thereof. Bracket 122 is comprised of an upper, generally planar portion 126 of plate steel for example, and depending, spaced-apart gusset portions 128 which are rigidly affixed with respect to portion 126 as by welding to form a rigid unitary support bracket structure. Laterally inner portions of support bracket elements 126 and 128 form the mounting portion 124 having surfaces which engage the respective surfaces 118 and 120 in assembly of the bracket 122 to bearing adapter 110. Bracket 122 thus is affixed with respect to bearing adapter 110 as by welding or by removable fasteners to form a rigid, unitary bearing adapter and steering arm support structure which extends axially outward of the corresponding wheelset bearing.

Figure 11:
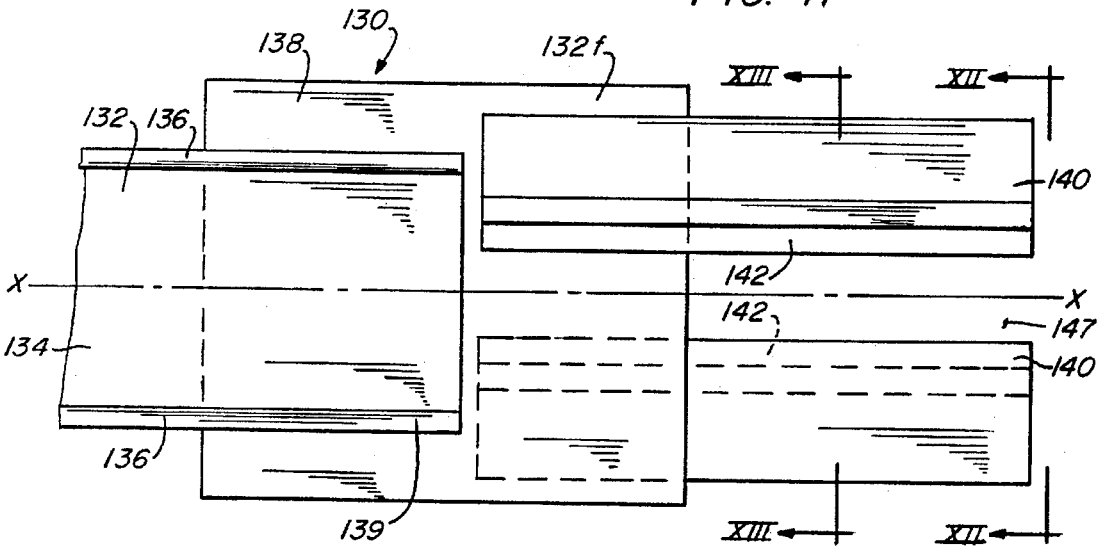
FIG. 11 is a fragmentary top plan view of a preferred form of a steering arm free end.
Figure 12:
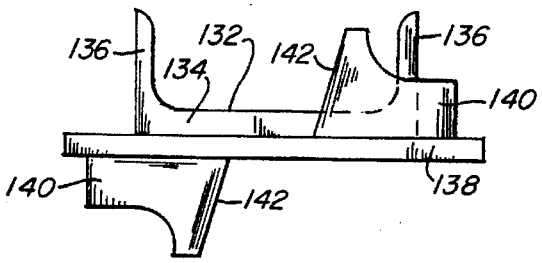
FIG. 12 is an end elevation taken on line XII—XII of FIG. 11.

In a preferred form of the steering arms of the invention as shown FIGS. 11 and 12, an elongated arm 130 includes a portion 132 having an elongated web portion 134 which is preferably formed integrally with a pair of laterally spaced flange portions 136. The dimensions of flange portions 136 and web 134 are chosen in accordance with accepted engineering practice to provide an essentially rigid steering arm structure with suitable bending strength and torsional stiffness as required for proper performance of the described steering function.

Adjacent an outer or free end **132*f* of the steering arm 130 a transition plate 138 is rigidly fixed as by welding to the free or outer end 139 of arm portion 132. A pair of elongated abutment members 140 also are rigidly fixed as by welding to an adjacent portion of transition plate 138 and extend longitudinally outward therefrom in laterally spaced relation with respect to a longitudinal axis X—X of steering arm 130. As shown in FIGS. 11 and 12, abutment members 140 are preferably identical members which are fixed to opposed sides of transition plate 138. Each of the abutment members 140 presents an elongated abutment surface 142 which faces laterally inward generally toward axis X—X. As the abutment members of each steering arm 130 are affixed as described in opposed orientations to upper and lower surfaces of transition plate 138, the corresponding abutment surfaces 142 form upper right and lower left abutment surfaces, respectively, when viewed as if FIG. 12**.

Figure 13:
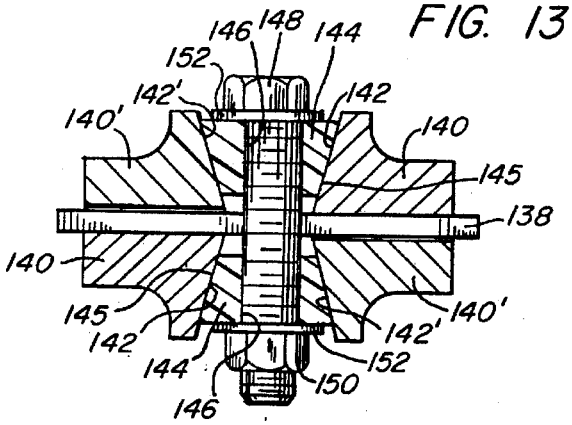
FIG. 13 is a sectional view taken on line XIII—XIII of FIG. 11 and showing a pair of the steering arm free ends of FIG. 11 interengaged.

In assembly of the steering apparatus as above described, a pair of the steering arms 130 have the respective portions 132 rigidly affixed to respective brackets 122 with the free end portions **132*f* of the steering arms extending toward one another and interengaging as shown in FIG. 13. Specifically, when a steering arm 130 is turned end for end with respect to another steering arm 130 so that their free ends 132*f* can be interengaged, the abutment members 140 of the one steering arm end portion 132*f* are positioned as above described whereas the abutment members of the other steering arm end portion 132*f*, labeled 140' in FIG. 13, provide mating upper left and lower right abutments with corresponding surfaces 142' thereof opposing the respective upper and lower abutment surfaces 142 of members 140**.

A pivot connection between the interengaged steering arm free end portions **132*f* is comprised of a pair of generally conical, hard elastomeric bushing members 144 of a polyurethane material for example, each having an axial through opening 146 to receive a clamping assembly such as a threaded bolt 148 with a nut 150 and washers 152. with the bushings 144 positioned in axially aligned orientation as shown, an outer conical surface 145 of each engages a pair of the abutment surfaces 142, 142'. Bolt 148 is received within openings 146 with washers 152 axially outward of the respective bushings 144, nut 150 is threadedly engaged on bolt 148 to maintain the generally conical surfaces 145 of bushings 144 in engagement with respective abutment surfaces 142 and 142'**.

Each bushing 144 thus is cooperable with abutment elements 140 to transfer lateral loads induced by lateral impetus of one steering arm with respect to the other. This holds true regardless of a lateral direction of steering arm impetus, and regardless of in which steering arm the lateral impetus originates.

For example, and referring again to FIG. 13, if the steering arm **132*f* carrying abutment members 140' imparts a lateral impetus toward the right, that impetus will be transferred through compressive lateral force by upper abutment member 140' on the upper bushing 144 to the laterally opposed abutment member 140 of the other steering arm end portion 132*f*. If the lateral impetus to the right instead originates in the steering arm end portion 132*f* which carries abutment members 140, then a similar load transfer to the other steering arm end portion 132*f* occurs through compressive forces on the lower bushing member 144**. The same sort of compressive loading transfers leftward directed lateral impetus from one steering arm end portion to the other.

The interengagement of the steering arms and the cooperating elastomeric bushing 144 and bolt clamping assembly, also affords freedom between the interengaged steering arms for relative longitudinal translation as noted above, as well as relative longitudinal pitch and lateral roll freedom. Specifically, the interengagement of abutment members 140 and 140' effectively encloses both ends of an elongated slot 147 defined laterally therebetween while abutment surfaces 142 and 142' enclose the longitudinal extent of the slot 147. Bushings 144 and the bolt and nut clamping assembly are thus confined within slot 147. Relative longitudinal translation between the steering arm free ends **132*f*, 132*f* is insufficient to allow the interengaged abutment members 140, 140'** to disengage, whereby the bushing and bolt clamping assembly is positively confined.

During such relative longitudinal translation, each abutment surface 142 will move incrementally in the longitudinal direction with respect to its counterpart abutment surface 142'. Since the corresponding bushing 144 is in rolling engagement with both of the surfaces 142 and 142', the engagement of bushings 144 on the respective abutment surfaces 142 and 142' will not inhibit relative longitudinal translation between the interengaged steering arms 130.

Longitudinal pitch freedom between the steering arm end portions is also available, although not strictly required as a mode of freedom to accommodate relative movement between the truck wheelsets. The longitudinal pitch freedom does, however, allow the steering arm end portions **132*f*, 132*f'* to be interengaged and the bushing and bolt clamping assembly to be assembled to them without requiring precise longitudinal alignment between the steering arm end portions 132*f*, 132*f'*. Accordingly, minor deviations from the specification dimensions or geometry in the fit up between the side frame pedestal openings and the bearing adapters will not interfere with assembly of the steering arm end portions 132*f* and 132*f'*** with each other, or with installation of the bushing and bolt clamping assembly thereon.

In relative horizontal roll between the interengaged steering arm end portions **132*f*, 132*f'*, one pair of abutment members such as members 140 will tend to move in rolling movement with respect to the other pair of abutment members 140'. Accordingly, the one pair of abutment members 140 will tend to be displaced upwardly or downwardly with respect to the abutment members 140', and will further tend to rotate in coordination with this vertical translation about an axis extending generally parallel to the steering arm axis X—X. The bushings 144 permit this mode of relative movement also. For example, in a lateral roll movement which causes abutment members 140 to translate vertically upward and rotate counterclockwise with respect to abutment members 140', the only constraining impetus at the interconnected steering arm ends will be very slight compressive deformation of the upper and lower bushings 144 in the lateral direction due to the rotational component of the rolling movement. Relative lateral roll movements of abutment members 140 with respect to members 140' in the opposed rotary sense will tend to incrementally reduce compressive loading on the respective bushings 144. In either case, due to the very limited range of available lateral roll between the truck wheelsets and the lateral displacement of the steering arms from the typical roll axis, the angular displacement of abutment members 140 with respect to members 140' in lateral roll is very slight. Accordingly, the compressive loading on elastomeric bushings 144 will not be significantly affected by relative lateral roll between the wheelset axes. Furthermore, lateral load transfer between the connected steering arms through compressive loading on elastomeric bushings 144** also will not be significantly affected by relative lateral roll between the truck wheelsets.

As mentioned above, minor deviations from specification dimensions may result in interengagement between the steering arm end portions **132*f*, 132*f'* which deviates from the desired steering arm engagement setup. The interengagement configuration shown in FIG. 13 permits assembly of the steering arm connection without regard to such deviations. If one pair of abutment members 140 do not align precisely with their counterparts 140', either in relative lateral or vertical position, or in relative angular position with respect to X—X, the bushings 144 may still be assembled to the interengaged arm end portions 132*f*, 132*f'*, and the bolts 148 and nut 150 assembled thereto to confine the bushings 144** as above described.

More specifically, relative vertical or lateral deviation or misalignment in the preferred position of abutment elements 140 with respect to their respective counterparts 140' does not disturb the vertical alignment of one pair of abutment surfaces 142, 142' with the other pair of abutment surfaces. Further, such lateral or vertical misalignment also does not disturb the angular relationship between respective pairs of abutment surfaces 142 and 142'. Finally, as discussed above, a mismatch in angular position of abutment members 140 with respect to their counterparts 140' will affect the angular relationship between the corresponding surfaces 142 and 142' only negligibly.

For example, relative lateral displacement of one pair of abutment members 140 with respect to the corresponding members 140' merely increases the spacing between one pair of cooperating surfaces 142 and 142', and decreases the spacing between the other pair of cooperating surfaces 142 and 142'. Under these conditions, the vertical position at which each of the upper and lower bushings 144 engages respective surfaces 142 and 142' will be shifted upward or downward, depending upon whether the relative lateral movement between the surfaces 142 and 142' increases or decreases the spacing therebetween. The vertical axis of bushings 144 also will shift laterally, but the axis shift is in the same lateral direction and the same magnitude for both pairs of surfaces 142 and 142'. Relative vertical displacement of one pair of abutment members 140 with respect to the corresponding abutment members 140' produces similar consequences regarding the position of engagement for bushings 144 with respective surfaces 142 and 142'. For both lateral and vertical deviations from specified positions of the steering arms, the converging angular relationship between the pairs of abutment surfaces 142 and 142' will remain the same.

Further, since the contact between the planar abutment surfaces 142, and 142' and the respective conical surfaces 145 of bushings 144 is essentially line contact, initial assembly of bushings 144 with the abutment members 140, 140', including assembly thereto of the bolt 148 and nut 150, is quite a simple matter due to the very limited area of surface engagement between bushing surfaces 145 and abutment members 140 and 140'. This provides maximum adjustability for bushings 144 on initial assembly, and correspondingly, maximum ease of assembly.

According to the description hereinabove, I have invented a novel and improved railway truck and steering apparatus therefor which affords longitudinal freedom between the truck wheelsets in conjunction with controlled interaction between the wheelsets to enforce opposing wheelset yaw excursions. The invention provides for improved ease and simplicity of assembly for a truck including the novel steering apparatus, as well as low manufacturing cost, reliable operation and simple structural design. 0f course, I have contemplated various alternative and modified embodiments apart from those disclosed hereinabove, and surely such alternatives would also occur to others versed in the art once apprised of my invention. Accordingly, the invention should be construed broadly and limited only by the scope of the claims appended hereto.

I claim:

1. In a railway truck including a pair of wheelsets which are adapted to engage a railway track at longitudinally spaced locations thereon, which wheelsets support a pair of laterally spaced side frames and a bolster that extends laterally intermediate the side frames, and wherein the wheelsets are movable with respect to each other and with respect to the side frames in longitudinal translation and in horizontal yaw, a steering apparatus for controlling relative wheelset movement comprising:

a pair of rigid, elongated steering members each having a mounting portion and an engagement portion spaced longitudinally from said mounting portion;

means cooperating with said mounting portions, respectively, for rigidly affixing said steering members with respect to respective wheelset axle ends at one lateral side of the truck in a manner that each said steering member is rigidly constrained to move in unison with the wheelset axle end to which it is affixed, respectively in longitudinal translation and horizontal yaw;

said steering members having said engagement portions extending adjacent to each other; and connection means cooperable with said engagement portions to connect said pair of steering members in a manner that relative movement of one wheelset in horizontal yaw with respect to the truck side frames imparts a laterally directed impetus tending to move the other wheelset in the opposed yaw direction while the wheelsets remain movable independently of each other in longitudinal translation throughout at least a given range of horizontal yaw movement.

2. The steering apparatus as set forth in claim 1 wherein said engagement portions include elongated aperture means formed in each said steering member, said aperture means of said steering members being disposed at least partially in mutual registry, and said connection means includes pivot pin means extending in pivotal engagement with said steering members within mutually registering portions of said aperture means.

3. The steering apparatus as set forth in claim 2 wherein said aperture means of at least one of said steering members extends generally perpendicular to the rolling axis of the respective wheelset.

4. The steering apparatus as set forth in claim 2 wherein said pivot pin means is movable longitudinally of the respective said elongated aperture means, respectively, throughout a range of mutual registry between said elongated aperture means.

5. The steering apparatus as set forth in claim 1 including two pairs of said steering members extending longitudinally intermediate the truck wheelsets laterally outwardly adjacent the truck side frames, respectively.

6. The steering apparatus as set forth in claim 1 including two pairs of said steering members extending longitudinally intermediate the truck wheelsets vertically above the truck side frames, respectively.

7. A railway truck comprising:

a pair of wheelsets which are adapted to engage a railway track at longitudinally spaced locations thereon;

a pair of laterally spaced side frames supported by said wheelsets;

an elongated bolster extending laterally intermediate said side frames and being supported thereby;

said wheelsets being engaged with said side frames, respectively, in a manner to be movable in longitudinal translational movement and in horizontal yawing movement with respect to said side frames and with respect to each other;

a pair of rigid, elongated steering members each having a mounting portion and an engagement portion spaced longitudinally from said mounting portion;

means cooperating with said mounting portions, respectively, for rigidly affixing said steering members with respect to the respective axle ends of said wheelsets at one lateral side of the truck in a manner that each said steering member is rigidly constrained to move in unison with the respective said wheelset to which it is affixed, respectively, in longitudinal translation and horizontal yaw;

said steering members having said engagement portions extending adjacent to each other; and connection means cooperable with said engagement portions to connect said pair of steering members in a manner that relative movement of one of said wheelsets in horizontal yaw with respect to said side frames imparts a laterally directed impetus tending to move the other of said wheelsets in the opposed yaw direction while said wheelsets remain movable independently of each other in longitudinal translation throughout at least a given range of horizontal yaw movement.

8. The railway truck as set forth in claim 7 wherein said engagement portions include elongated aperture means formed in each said steering member, said aperture means of said steering members being disposed at least partially in mutual registry, and said connection means includes pivot pin means extending in pivotal engagement with said steering members within mutually registering portions of said aperture means.

9. The railway truck as set forth in claim 8 wherein said aperture means of at least one of said steering members extends generally perpendicular to the rolling axis of the respective said wheelset.

10. The railway truck as set forth in claim 8 wherein said pivot pin means is movable longitudinally of the respective said elongated aperture means, respectively, throughout a range of mutual registry between said elongated aperture means.

11. The railway truck as set forth in claim 7 including two pairs of said steering members extending longitudinally intermediate said wheelsets laterally outwardly adjacent said side frames, respectively.

12. The railway truck as set forth in claim 7 including two pairs of said steering members extending longitudinally intermediate said wheelsets vertically above said side frames, respectively.

13. In a railway truck having a pair of longitudinally spaced wheelsets with wheels which are adapted to be supported in rolling engagement on railway track rails wherein the wheelsets are movable relatively with respect to each other at least in longitudinal translation and horizontal yaw, a steering apparatus for controlling relative movement of the spaced wheelsets with respect to each other comprising:

elongated steering means adapted to be affixed to and extend longitudinally between the longitudinally spaced wheelsets, respectively;

means for rigidly affixing portions of said steering means with respect to the truck wheelsets, respectively, in a manner that said portions of said steering means move in unison with the truck wheelsets, respectively, during wheelset excursions including relative longitudinal translation and relative horizontal yaw therebetween;

said portions of said steering means including a pair of elongated steering members, respectively, extending longitudinally toward each other from the respective wheelsets; said pair of steering members having a respective pair of mutually cooperating engagement means disposed in mutual registry to receive a connection means;

connection means cooperable with said engagement means to interconnect said pair of steering members for transfer of loads therebetween upon movement of one truck wheelset with respect to the other; and said engagement means including plural pairs of confronting abutment surfaces and said connection means including means disposed intermediate said pairs of confronting abutment surfaces, respectively, to transfer mechanical loads from one of said steering members to the other.

14. The steering apparatus as set forth in claim 13 wherein said engagement means includes pivot means forming a pivot axis for relative pivoting of said steering members with respect to each other.

15. The steering apparatus as set forth in claim 13 wherein at least one of said pairs of confronting abutment surfaces is a pair of elongated surfaces oriented to extend generally longitudinally intermediate the truck wheelsets.

16. The steering apparatus as set forth in claim 14 wherein at least one of said pairs of confronting abutment surfaces is a pair of non-parallel surfaces.

17. The steering apparatus as set forth in claim 16 wherein said non-parallel surfaces include a pair of elongated planar surfaces which converge in the direction of the axial extent of said pivot means.

18. The steering apparatus as set forth in claim 17 wherein said pivot means includes converging surface means which is cooperable for force bearing engagement with said pair of non-parallel surfaces.

19. The steering apparatus as set forth in claim 18 wherein said converging surface means includes conical surface means.

20. The steering apparatus as set forth in claim 19 wherein said conical surface means is an exterior surface portion of a generally conical bushing means received intermediate said pair of non-parallel surfaces.

21. The steering apparatus as set forth in claim 20 wherein said pivot means includes clamp means for clamping said bushing means in engagement with said non-parallel surfaces.

* * * * *